United States Patent [19]

Alexander

[11] 4,119,108

[45] Oct. 10, 1978

[54] AUTOMATIC WASHING APPARATUS

[75] Inventor: Robert Osteen Alexander, Mitcham, England

[73] Assignee: Cera International Limited, London, England

[21] Appl. No.: 843,061

[22] Filed: Oct. 17, 1977

[51] Int. Cl.[2] ..... B08B 3/02

[52] U.S. Cl. ..... 134/62; 134/66; 134/79; 134/109; 134/142; 118/319; 198/404

[58] Field of Search ..... 134/43, 62, 66, 69, 134/78-79, 109, 134, 142; 198/404; 118/319

[56] References Cited

U.S. PATENT DOCUMENTS

| | | | |
|---|---|---|---|
| 3,102,057 | 8/1963 | Umbricht et al. | 134/69 X |
| 3,648,742 | 3/1972 | Beech | 134/62 X |
| 3,774,625 | 11/1973 | Wiltrout | 134/109 X |
| 3,860,019 | 1/1975 | Teague | 134/109 |
| 4,055,246 | 10/1977 | Zalewski | 134/66 X |
| 4,062,437 | 12/1977 | Knapp | 134/79 X |

*Primary Examiner*—Robert L. Bleutge

*Attorney, Agent, or Firm*—Cushman, Darby & Cushman

[57] ABSTRACT

An industrial washing machine for washing each of a continuous flow of production components in turn has a group of jets mounted in a respective manifold casing at each of one or more washing stations. Each manifold casing is hinged to fixed structure and is held in abutment with a locator stop by a toggle lever latch. Each jet is precisely located in position for use by the combination of the respective locator stop and hinge and can be swung from that position when the respective latch is released in order to facilitate access to the jets for cleaning and/or access to a production component which is supported at the respective washing station for cleaning so that, if such a production component should be displaced, relocation is facilitated. The jets in each manifold casing have a smaller diameter and longer bore than do the remaining jets in the washing section of the machine. Washing fluid fed to each manifold casing is passed first through primary and secondary filters whereas the washing fluid fed to the other jets is passed through the primary filters only.

10 Claims, 7 Drawing Figures

AUTOMATIC WASHING APPARATUS

This invention relates to industrial washing machines for washing production components and more particularly for washing each of a continuous flow of production components in turn, the continuous flow of production components being produced by part of a production line.

Such machines which shall be referred to hereinafter as "industrial washing machines of the kind referred to", comprises pressure fluid supply means for drawing washing fluid from a source of such fluid and for feeding it under pressure to and through at least one battery of jets which are mounted and located with precision at at least one washing station, and supporting and locating means for supporting and locating each component in turn at the or each washing station so that each of the jets directs a pressure jet of washing fluid at a corresponding specific part of a component which is supported and located at that station by the supporting and locating means when the machine is in use.

The standard supporting and locating means for supporting and locating a battery of jets at a washing station comprise rigid support structure in which each jet is mounted rigidly and which is bolted in position.

The jets tend to become blocked with matter such as dirt or swarf that is flushed from production components that are washed by the machine. This is particularly likely to occur if the specific part of a production component at which a jet is directed is a blind hole. Also a component which is supported by the supporting and locating means can be displaced from the location at which it is to be supported by the supporting and locating means during operation of the apparatus.

An object of this invention is to provide improved supporting and locating means for supporting and locating a group of jets of a washing station of an industrial washing machine of the kind referred to.

A preferred form of industrial washing machine of the kind referred to in which this invention is embodied, has jets mounted rigidly in a respective manifold casing in which a pressure fluid flow path is formed for directing to each jet of the battery washing fluid which is supplied under pressure by the pressure fluid supply means. Locating means are provided for providing precise location for each manifold casing at the respective washing station so that each battery of jets is located with precision at the respective washing station when the machine is in use. The locating means for each manifold casing comprise a respective locator stop, which may be adjustable, and a hinge arrangement by which the manifold casing is hinged to fixed structure of the machine so that, when the respective releasable latching means are released, it can be swung to and from the position in which it abuts the respective locator stop. Releasable latching means are provided for retaining each manifold casing releasably in abutment with the respective locator stop, the latching means being releasable to permit removal of the manifold casing from the position at which it is located precisely at the respective washing station by the respective locating means and being adapted to reclamp the manifold casing subsequently in the same precise position that is determined by the respective locating means. The pressure fluid flow path formed in each manifold casing is connected to the pressure fluid supply means by a flexible pipe.

The jets that are mounted in each manifold casing are special jets which have longer bores of a smaller diameter, say less than ¼ inch and usually of the order of ⅛ inch or 3/16 inches, than do jets of standard dimension that are normally used and which have a diameter greater than ¼ inch, usually of the order of ½ or ⅜ inches. The special jets direct jets of washing fluid with a higher degree of precision than can be expected when the standard jets are used.

The pressure fluid supply means comprise a sump for collecting washing fluid drained from each washing station during operation of the machine, a tank, one pump which is operable to draw washing fluid from the sump and to feed it to the tank via primary filtering means, such as hydrocyclones, and another pump which is operable to draw washing fluid from the tank and to feed it under pressure directly to any standard jets that are mounted in the washing section and indirectly to each manifold casing via secondary filtering means.

An industrial washing machine in which this invention is embodied and which is for cleaning engine blocks will be described now by way of example with reference to the accompanying drawings, of which:

Figure 1:
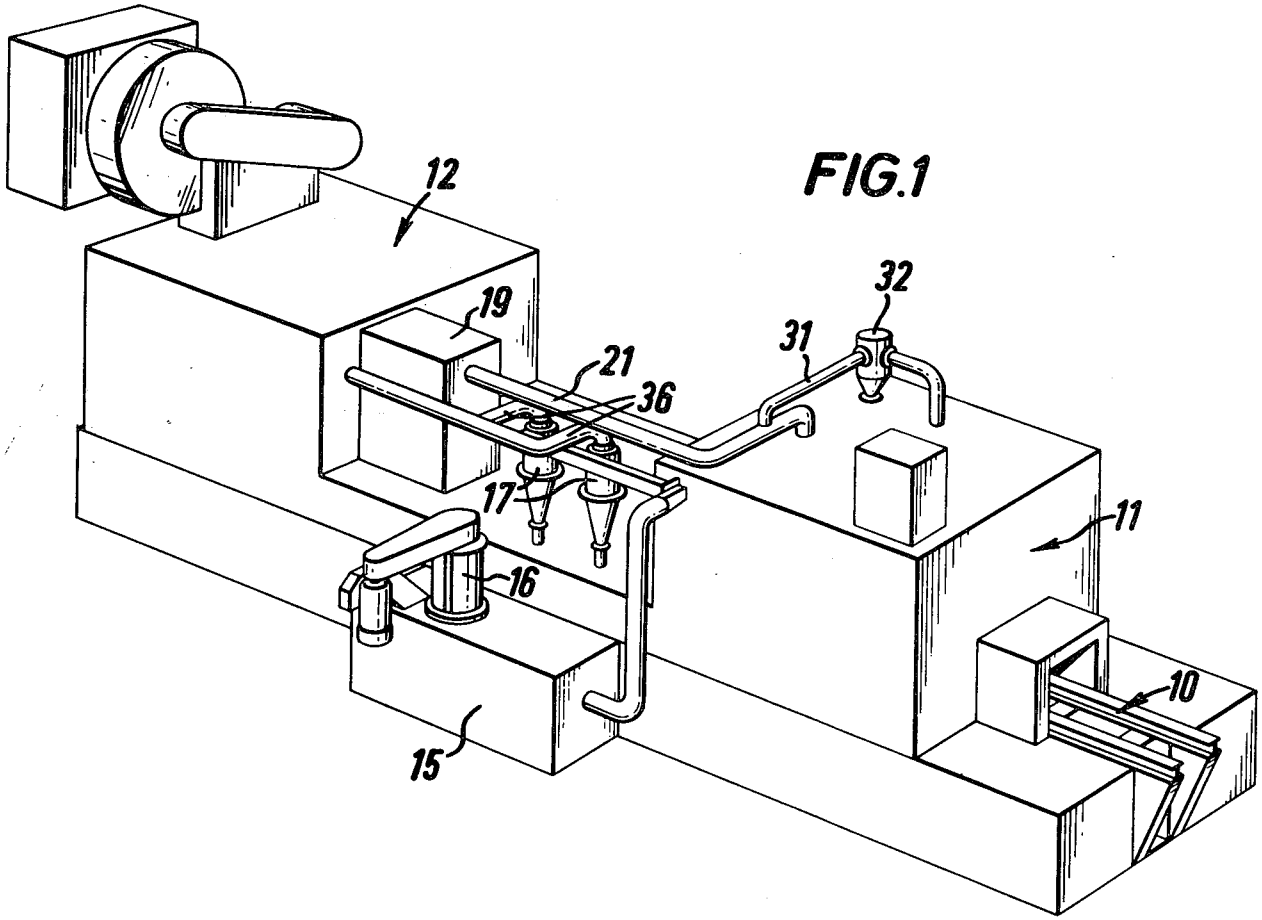
FIG. 1 is a perspective view of the machine.

The machine shown in FIG. 1 has an input station 10 at which each of a continuous flow of engine blocks produced by a production line are deposited one after another and comprises a fabricated housing in which the various sections of the machine are enclosed. Each engine block would have been subjected to a number of different manufacturing operations as it progressed along the production line. The manufacturing operations may include milling, drilling, tapping, broaching, honing or other forming or machining operations which result in each engine block being soiled with mineral oils, core sand, dirt or swarf.

Engine blocks received at the input station 10 of the machine are conveyed in a stepwise manner one behind another to a washing section 11 of the machine. After passage through the washing section 11, the engine blocks are conveyed in a stepwise manner one behind another to a drying section 12 of the machine. After passage through the drying section 12, the cleaned and dried engine blocks are conveyed in a stepwise manner one behind another to a discharge station (not shown) of the machine from which they are collected one after another for conveyance to another part of the manufacturing operation.

Figure 2:
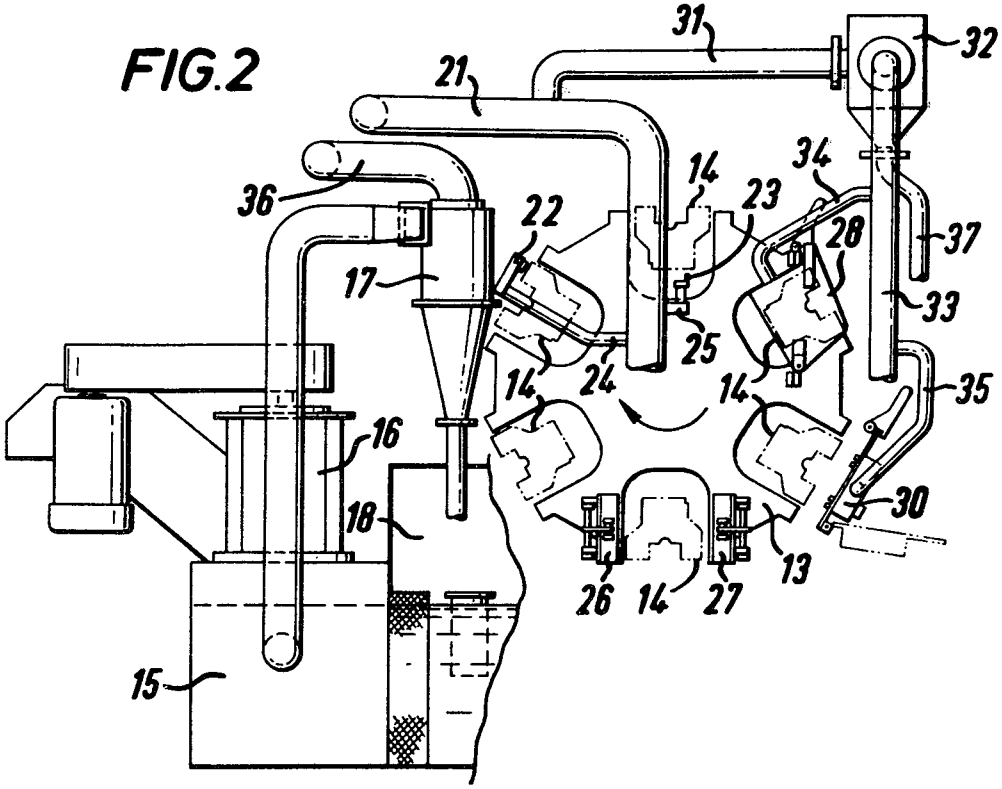
FIG. 2 is a diagrammatic illustration of the washing fluid circuit of the washing section, the washing section rotor being shown as seen along its axis.
Figure 3:
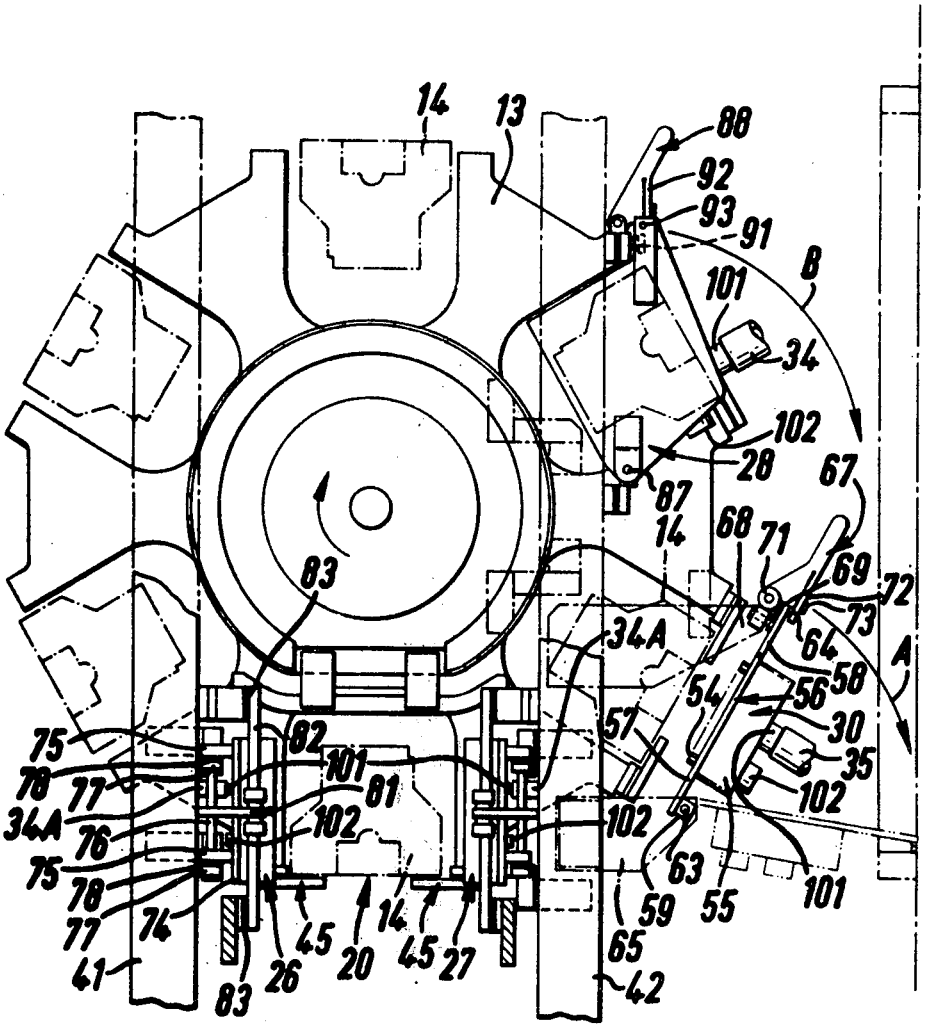
FIG. 3 is a view of the washing section rotor and part of the associated fabricated housing, as seen along its axis and drawn to a larger scale and FIG. 2.
Figure 4:
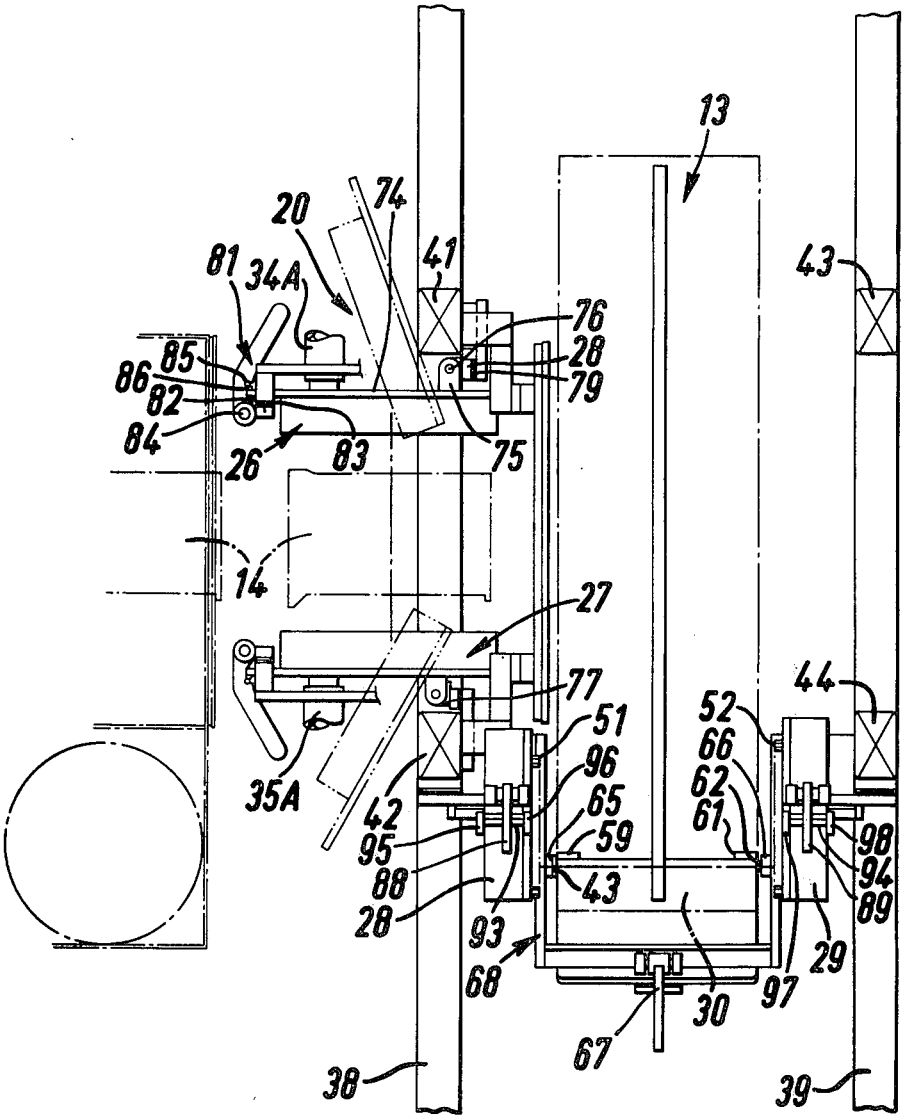
FIG. 4 is a plan view of the parts of the washing section of the machine that are shown in FIG. 3.
Figure 6:
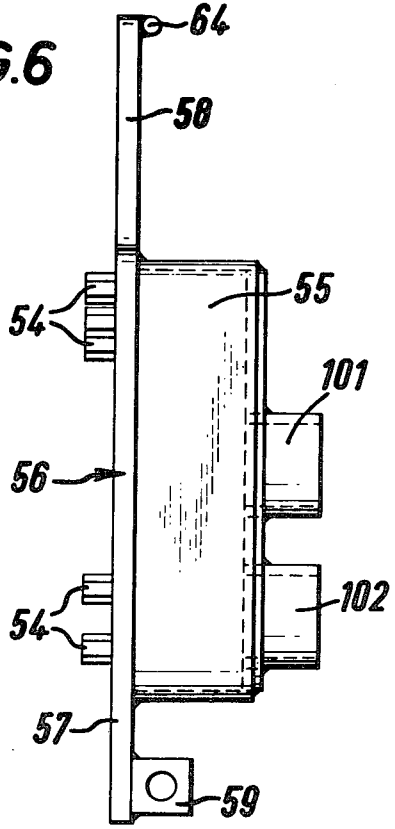
FIG. 6 is a side elevation of the manifold casing shown in FIG. 5.
Figure 5:
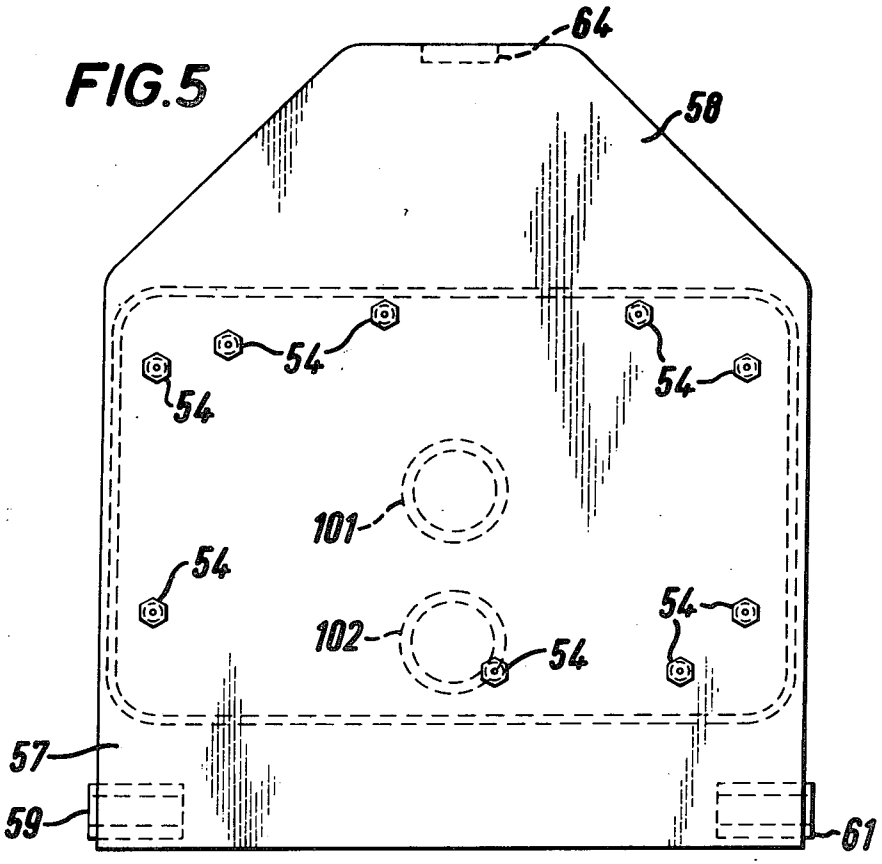
FIG. 5 is a front elevation of one of the manifold casings of the machine shown in FIGS. 1 to 4.

Both the washing section 11 and the drying section 12 of the machine comprise a rotor which carries supporting and locating configurations at a number of equally-spaced points around its circumference. Conveniently there are six such points equally-spaced around the circumference of both the washing section rotor 13, which is illustrated in FIGS. 2, 3 and 4, and the drying section rotor although choice of the actual number of such points is a question of design convenience. The supporting and locating configurations at each such point on the circumference of the washing section rotor 13 and of the drying section rotor are adapted to support and locate an engine block at each of a number of equally angularly spaced stations around its circumference. Each engine block to be washed is shown in chain dotted lines at 14 in FIGS. 2, 3 and 4. Each of the washing section rotor 13 and the drying section rotor is driven by a common driving mechanism by which it is indexed successively through angular steps which comprise the angular displacement between each adjacent pair of supporting and locating configurations so that each engine block 14 is transported in a stepwise manner through each of the stations of the washing and drying sections 11 and 12. The driving mechanism incorporates a suitable dwell mechanism so that each engine block dwells at each station of the washing and drying sections 11 and 12 where it is washed or dried according to the section 11, 12.

The washing section 11 also includes a pre-wash station 20 (see FIGS. 3 and 4) at which each engine block 14 is deposited in turn and washed before being presented to the supporting and locating configurations that are located at the first washing station when it arrives at that station.

A battery of precision located jets is provided at each of the pre-wash and washing stations of the washing section 11. The orientation of each jet is such that it is aligned with a corresponding blind hole, bore, cavity or other surface part of an engine block 14 which is supported and located at the respective washing station so that washing fluid fed to and through each jet orifice under pressure is directed at that aligned part of that engine block 14 as a jet. Some of the jets have standard size jet orifices and others are special jets which have jet orifices with smaller diameters and longer bores than do the standard jet orifices.

The machine has a sump 15 into which washing fluid that drains from each engine block 14 that is passed through the washing section 11 to the drying section 12 is directed. A first pump 16 is operable to draw washing fluid from the sump 15 through primary filtering means which comprise a pair of hydrocyclones 17 which are connected to the output of the pump 16 in parallel and which operate to separate particles of solid matter from the washing fluid. The filtered washing fluid is directed from the output of the hydrocyclones 17 to a storage tank 18 (see FIG. 2). A second pump 19 (see FIG. 1) is operable to draw washing fluid from the storage tank 18 and to feed it under pressure to the jets at each of the pre-wash and washing stations of the washing section 11.

The output of the second pump 19 is connected to a main conduit 21 from which several branch conduits extend. Each standard jet is mounted rigidly in its own support structure at the respective pre-wash or washing station and is connected to the main conduit 21 by a respective one of the branch conduits. For example, FIG. 2 shows a standard jet 22 at one of the washing stations and a standard jet 23 at another of the washing stations, the jet 22 being connected to the main conduit 21 by a branch conduit 24 and the jet 23 being connected to the main conduit 21 by another branch conduit 25. Similar standard jets may be mounted where required at any of the washing stations as required.

The various special jets at each of the pre-wash and washing stations are arranged in batteries and each battery of special jets is carried by a respective manifold casing 26, 27, 28, 29, 30 which is hinged to fixed structure of the machine and which is latched in position at the respective washing station against a respective locator stop by a toggle lever. Each manifold casing 26, 27, 28, 29, 30 is located with precision at the respective station of the washing section by the respective locator stop and hinge pin. Details of the construction and arrangement of the manifold casings, locator stops, hinged and toggle clamps at each station are described more fully below.

One, 31, of the branch conduits that extend from the main conduit 21 is connected to the input of a secondary filter unit 32 which conveniently incorporates a screen cartridge filter. Various particles of solid that were not removed from the washing fluid when that fluid was passed through the hydrocyclones 17 are separated from the washing fluid in the secondary filter unit 32 and are discharged from the secondary filter unit 32, the washing fluid being directed to a secondary conduit 33 from which various branches, including branches 34, 35 shown in FIG. 2 and branches 34A and 35A shown in FIGS. 3 and 4, extend. Each branch 34, 35 from the secondary conduit 33 comprises a flexible pipe and is connected to a respective one of the manifolds 28 and 30. The branches 34A and 35A comprise flexible pipes that are connected respectively to the manifolds 26 and 27. Hence washing fluid that has been filtered to a higher order of clarity than the washing fluid that is fed under pressure to the standard jets 22, 23 via the main conduit 21 and its branches 24, 25 is fed under pressure to the interior of each of the various manifold casings 26, 27, 28, 29, 30 which communicates with the orifices of the respective battery of special jets.

The secondary filter unit 32 may be a self-cleaning unit or may be adapted to be cleaned manually.

A drag conveyor extends below and at right angles to the conveyor by which engine blocks are carried from the washing section to the drying section. The solid matter separated from the washing fluid by operation of both the hydrocyclones 17 and the secondary filter unit 32 is discharged via the discharge pipes 36, in the case of the hydrocyclones 17, and by the discharge pipes 37 in the case of the secondary filter unit 32, and is deposited upon the drag conveyor which carries it to a sludge discharge station outside the machine so that it is not returned to the sump 15.

The fabricated housing includes a spaced pair of horizontal beams 38 and 39 and four vertical pillars 41, 42, 43 and 44 within the washing section 11, each of the beams 38 and 39 providing a foundation for a respective pair of pillars 41 and 42 or 43 and 44.

The pre-wash station 20 includes locating and supporting configurations 45 (see FIG. 3) for locating and supporting an engine block component 14 between the pair of similar manifold casings 26 and 27 at that station. The two manifold casings 26 and 27 are arranged symmetrically about the centre line of the pre-wash station 20. The special jets that constitute the battery of jets carried by each of the two manifold casings 26 and 27 are mounted in the opposed faces of those casings 26 and 27.

The first of the six washing stations that are disposed around the washing section rotor 13 is in line with the pre-wash station 20. The second of those six washing stations is displaced angularly from that first washing station in a clockwise direction as seen in FIGS. 2 and 3, the third washing station is displaced angularly from the second in the same sense and so on in series so that the sixth washing station is displaced angularly from the first in an anti-clockwise direction. There are locating and supporting configurations (not shown) for locating and supporting an engine block component 14 at each of the six washing stations.

The supporting and locating configurations at the fifth washing station are adapted to support an engine block component 14 between the pair of similar manifold casings 28 and 29 which extend radially and are disposed symmetrically, one on either side of the rotor 13 adjacent the outer periphery of the rotor 13 which rotates between them. At special jets at the fifth washing station are distributed between the two manifold casings 28 and 29 at that station and are mounted in the face of the respective casings 28, 29 that is nearest to the rotor 13. Those jets that are mounted in the casing 28 are shown generally at 51 in FIG. 4 and those jets are mounted in the casing 29 are shown generally at 52.

The special jets at the sixth washing station are mounted in a manifold casing 30 which is disposed radially-outwardly with respect to the outermost periphery of the rotor 13, these jets, which are shown generally at 54, being in the face of the casing 30 that is nearer the rotor 13 so that they point towards an engine block component 14 that is supported and located at the sixth washing station.

The mounting arrangement by which each of the five manifold casings 26 to 30 is located and mounted in position at the respective washing station with precision is broadly similar and the detailed construction of, and the particular mounting arrangement for the manifold casing 30 will be described now in detail by way of example with reference to FIGS. 3 to 6.

The manifold casing 30 comprises a generally rectangular hollow structure 55. The face of the manifold casing 30 in which the jets 54 are mounted is one of the major planar faces of the rectangular structure 55 and is formed by a base plate 56 which projects in opposite directions from both of the longer sides of the rectangular structure 55 to form flanges 57 and 58.

Each of a spaced pair of journal blocks 59 and 61, which are secured to the shorter flange 57 adjacent its outer edge and on the side of that flange 57 opposite the planar face in which the jets 54 are mounted, is adapted to receive a respective one of a coaxial pair of hinge pins 62 and 63. A length 64 of round bar is secured to the longer flange 58 at the centre of the outer edge of that flange 58 and on the side of that flange 58 opposite the planar face in which the jets 54 are mounted so that it extends substantially parallel to the adjacent side of the rectangular structure 55.

Each hinge pin 62, 63 is carried by a respective support plate 65, 66 which is fixed to a respective one of the two vertical pillars 42 and 44 so that it projects from that pillar 42, 44 in the manner of a cantilever, the two pins 62 and 63 being coaxial with their axes substantially horizontal and parallel to the axis of rotation of the rotor 13 and being located at the bottom of the sixth washing station with precision with respect to the location of a component 14 at that station. Hence the manifold casing 30 is mounted for swinging movement about a horizontal axis as indicated by arrow A in FIG. 3.

The length 64 of round bar co-operates with a toggle lever 67 which functions to hold the manifold casing 30 in the position shown in full lines in FIG. 3 which is its working position at the sixth washing station. The toggle lever 67 is mounted at the centre of the central section of a U-shaped support frame 68 which has each of the free ends of its two limbs secured to a respective one of the two vertical pillars 42 and 44 and which extends around the rotor 13 above the cantilever support plates 65 and 66 so that its central section extends substantially parallel to the axis of rotation of the washing section rotor 13 from one side to the other of that rotor. The central section of the U-shaped support frame 68 also carries an adjustable locator stop 69 which comprises a setscrew which is screwed into a tapped hole in the central section of the U-shaped support frame 68. The hinge pin of the toggle lever 67 and the locator stop 69 are both located with precision with respect to the location of a component 14 at the sixth washing station. The toggle lever 67 is adapted to hold the planar face of the base plate 56 in contact with the head of the locator stop screw 69 so that the manifold casing 30 is located in the position in which it is so latched by the toggle lever 67 by the respective hinge pins 65 and 66 and the locator stop screw 69.

The toggle lever 67 comprises a generally triangular plate which lies in a vertical plane and which has two sides which are substantially mutually perpendicular, a tubular body 71 which is formed at a corner of the plate which forms the larger of the two acute angles of the notional triangle and which is journaled upon the respective hingepin so that it is substantially normal to the plane of the plate, and a handle which comprises a projection from the other corner of the notional triangle. A slot, which extends substantially parallel to the handle, which is aligned with it and which opens into the opposite side of the plate that is nearer to the right angled corner of the notional triangle than to the tubular body 71, separates a finger 72 from the remainder of the plate. The finger 72 projects beyond the open end of the slot away from the handle. The finger 72 co-operates with the length 64 of round bar to latch the longer flange 58 of the casing 30 against the adjustable stop 69. A setscrew 73 is passed through the finger 72, across the slot and is screwed into the main part of the plate to lock the toggle lever 67 in the latched condition shown in FIG. 3.

The manifold casing 26 at the pre-wash station 20 is a hollow rectangular structure which has a rectangular backplate 74. A pair of hinge arms 75 project from the rear planar face of the backplate 74 adjacent one of the shorter sides of the backplate 74 and at right angles to that rear face. That part of the backplate 74 which forms the other of its shorter sides projects beyond the remainder of the manifold casing 26. A hinge pin 76 has its ends spigotted into corresponding holes which are formed in the pair of hinge arms 75 so that its longitudinal axis is parallel to the backplate 74. The hinge pin 76 is journaled in a spaced pair of support blocks 77 which are mounted on the vertical pillar 41, the longitudinal axis of the hinge pin 76 being vertical. Each support block 77 is below the respective hinge arm 75 so that the weight of the manifold casing 26 is borne by the support blocks 77. Shims 78 between each hinge arm 75 and the respective support block 77 accurately locate the hinge arms 75 vertically relative to the support blocks 77. The location of each support block 77 with respect to the vertical pillar 41 is determined by shims 79 (see FIG. 4).

The portion of the backplate 74 that projects beyond the remainder of the manifold casing 26 co-operates with a respective toggle lever 81 which functions to latch the manifold casing 26 in its working position at the pre-wash station 20. The toggle lever 81, which is further from the washing section rotor 13 than are the hinge arms 75, retains the projecting part of the front planar face of the backplate 74 in abutment with an adjustable stop (not shown). Both the toggle lever 81 and the adjustable stop are carried by a support beam 82 which extends vertically and which is supported at its ends from the vertical pillar 41. Shims 83 locate the ends of the beam 82 accurately with respect to the vertical beam 41.

The toggle lever hinge pin 84 is supported from the vertical beam 82 with its axis vertical. The toggle lever 81 comprises a tubular body which is journaled upon the hinge pin 84 and a cranked plate which projects from the tubular body in a substantially horizontal plane. A short length 85 of round bar is fixed to the cranked plate portion of the toggle lever 81 at the inner edge of the elbow with its axis vertical and co-operates with a pad 86 to latch the backplate 74 of the manifold casing 26 against the adjustable stop. The pad 86 is mounted at the end of the rear planar face of the backplate 74.

The manifold casing 27 is supported and located in a similar manner to that which has just been described for the manifold casing 26 and components of the supporting and locating means for the two casings 26 and 27 as well as parts of these two casings 26 and 27 are identified by the same references. The jets carried by each manifold casing 26, 27 are formed in the face of that casing that is remote from the respective backplate 74 and which faces a component 14 that is located and supported at the pre-wash station 20, when the manifold casing 26, 27 is latched in position with its backplate 74 in abutment with the adjustable stop as shown in full lines in FIGS. 3 and 4 of the drawings.

The outer portion of the cranked plate portion of each toggle lever 81 serves as a handle by which that toggle layer 81 can be rotated manually about its hinge pin 84 to release the respective manifold casing 26, 27 for pivotal movement about its hinge pin 76 to the position shown chain dotted in FIG. 4. The jets that are carried by each manifold casing 26, 27 are readily accessible for cleaning purposes when that manifold casing 26, 27 is located in the position shown chain dotted in FIG. 4. Also displacement of either of the manifold casings 26 and 27 to the position that is shown chain dotted in FIG. 4 facilitates access to an engine block component 14 which is positioned in the pre-wash station 20 so that, for example, it is a fairly simple task to relocate that engine block component 14 if it should have been dislodged from the position in which it is supposed to be located.

The manifold casings 26 and 27 are located in the position in which they are latched by the toggle levers 81, as shown in full lines in FIG. 4, by the respective hinge pin 76 and the adjustable stop carried by the respective support beam 82.

Each of the manifold casings 28 and 29 at the fifth washing station is a hollow generally rectangular structure and is mounted pivotally upon a respective hinge pin which is located with precision with respect to and which is mounted upon a respective one of the vertical piilars 42 and 44 of the machine in a manner which is similar in principle to that which has been described above with respect to the mounting of the hinge pins 84 for the manifold casings 26 and 27. The location of the hinge pin which is journaled at one corner of the generally rectangular manifold casing 29 will be apparent from the similar location of the hinge pin 87 of the generally rectangular manifold casing 28 as shown in FIG. 3. The axes of the hinge pins for the casings 28 and 29 are horizontal. Hence the manifold casings 28 and 29 are mounted to swing in vertical planes (as indicated by arrow B in FIG. 3), because their generally planar faces in which their jets 51, 52 are mounted are normal to the axes of the respective hinge pin.

Toggle levers 88 and 89, which are generally similar to the toggle levers 67 which are described in detail above, are provided for latching each manifold casing 28, 29 against a respective adjustable stop.

The hinge pins for the toggle levers 88 and 89 and the respective adjustable stops are located with precision with respect to and upon the respective one of the vertical pillars 42 and 44 in a similar manner to the hinge pins for the manifold casings, 28 and 29. Hence, like the other three manifold casings 26, 27 and 30, the manifold casings 28 and 29 are located in the position in which they are latched by the respective toggle lever 88, 89, by the respective hinge pin by which they are hinged to the respective vertical pillar 42, 44 and by the respective adjustable stop. FIG. 3 shows that the adjustable stop for the manifold casing 28 is provided by the head of a setscrew or bolt 91 which is carried by the support means for the hinge pin of the respective toggle lever 88.

Each of the finger 92 of the toggle lever 88 and the finger (not shown) of the toggle lever 89 co-operates with a respective pin 93, 94 which extends between a respective pair of side plates 95 and 96, 97 and 98 which are fixed to opposite sides of the respective manifold casing 28, 29 to latch a locating surface (not shown) of the respective manifold casing 28, 29 against the respective adjustable stop. Setscrews similar to the setscrew 73 of the toggle lever 67 also lock the toggle levers 88 and 89 in the latched condition.

Each flexible pipe 34, 34A, 35, 35A is fitted onto an appropriate one 101 of a pair of tubular bosses 101 and 102 (see FIGS. 5 and 6) with which each of the manifold casings 26 to 30 is provided. The tubular boss 102 is stopped by a suitable bung for normal operation of the apparatus. The bores of both the bosses 101 and 102 of each manifold casing 26 to 30 communicate with the interior of the hollow casing.

Figure 7:
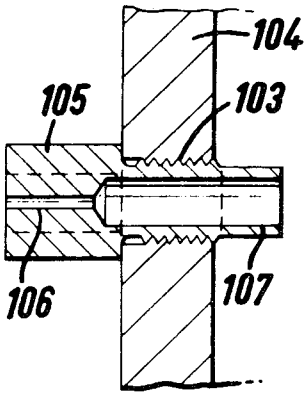
FIG. 7 is a longitudinal cross-section of a typical one of the jets of the manifold casing shown in FIGS. 5 and 6.

The special jets conveniently are mounted removably within the hollow casing of each manifold casing 26 to 30. FIG. 7 shows that such a jet is screwed into a tapped bore 103 in the appropriate wall 104 of the hollow casing. The jet has an enlarged head 105 at its outer end and a two diameter stepped bore, the smaller diameter bore portion 106 forming the jet discharge nozzle. The larger diameter bore portion 107 is in communication with the interior of the hollow casing.

Each of the toggle levers 67, 81, 88 and 89 can be rotated manually, after removal of the respective setscrew in the case of the levers 67, 88 and 89, to release the respective manifold casing 26 to 30 for pivotal movement about its hinge pin to the position shown chain dotted in FIG. 4 in the case of the casings 26 and 27 or away from the rotor 13 in the direction of the respective arrow A or B as shown in FIG. 3. When one of the manifold casings 26 to 30 is so located, the engine block component 14 at the respective washing station can be readily relocated if it had been dislodged. Also the jets that are carried by the manifold casings 26 to 30 are readily accessible for removal for cleaning purposes when that manifold casing 26 to 30 is so located. At the same time the bung may be removed from the tubular boss 102 to allow the interior of the respective hollow casing to be flushed out by a flow of liquid in order to clean out its interior.

Once the jets and the interior of the hollow casings have been cleaned, or the engine block component 14 relocated at the respective washing station, the respective manifold casing 26 to 30 is easily repositioned by pivotal movement until it abuts its respective adjustable stop where it is correctly located and is relatched in position by operation of the respective toggle clamp lever 67, 81, 88 or 89. One or more manifold casings which each carry a group of jets may be located and mounted in position with precision at any of the prewash and main washing stations of the washing section to suit requirements for cleaning a particular engine block or similar component. Use of such manifold casings is not to be taken to be limited to their use in the five locations that are described above with reference to the accompanying drawings. The mounting arrangement by which each such a manifold casing is located and mounted in position at the respective station would be broadly similar to that which has been described above for the manifold casings 26 to 30.

I claim:

1. An industrial washing machine for washing production components, the machine comprising a housing; a washing section enclosed within the housing, the washing section including a source of washing fluid, at least one battery of jets which are mounted and located with precision at at least one washing station of the washing section and pressure fluid supply means for drawing washing fluid from said source and for feeding it under pressure to and through said at least one battery of jets; and supporting and locating means for supporting and locating each component in turn at each washing station so that each of the jets directs a pressure jet of washing fluid at a corresponding specific part of a component which is supported and located at that station by the supporting and locating means when the machine is in use; wherein the improvement comprises the provision of at least one manifold casing in which a plurality of said jets are mounted rigidly and in which a pressure fluid flow path is formed for directing to each of the jets mounted in the manifold casing washing fluid which is supplied under pressure by the pressure fluid supply means; there being locating means provided for providing precise location for each manifold casing at the respective washing station so that the jets mounted in that casing are located with precision at the respective washing station when the machine is in use, the locating means for each manifold casing comprising a respective locator stop; and releasable latching means which are provided for retaining each manifold casing releasably in abutment with the respective locator stop, the latching means being releasable to permit removal of each manifold casing from the position at which it is located precisely at the respective washing station by the respective locating means and being adapted to reclamp the respective manifold casing subsequently in the same precise position that is determined by the respective locating means.

2. An industrial washing machine according to claim 1, wherein the locating means for each manifold casing also include a hinge arrangement by which the respective manifold casing is hinged to fixed structure of the apparatus so that, when the respective releasable latching means are released, it can be swung to and from the position in which it abuts the respective locator stop.

3. An industrial washing machine according to claim 1, wherein each locator stop is mounted adjustably with respect to the housing.

4. An industrial washing machine according to claim 1, wherein the releasable latching means for each manifold casing and the respective locator stop are supported with respect to the housing by the same support structure, there being separate support structure for jointly supporting the releasable latching means and respective locator stop for each manifold casing where there is more than one manifold casing.

5. An industrial washing machine according to claim 1, wherein the pressure fluid flow path formed in each manifold casing is connected to the pressure fluid supply means by a respective flexible pipe.

6. An industrial washing machine according to claim 1, wherein the jets that are mounted in the or each manifold casing are mounted removably therein.

7. An industrial washing machine according to claim 1, wherein said at least one battery of jets comprise at least one standard jet mounted rigidly within its own fixed support structure and the jets that are mounted within said at least one manifold casing and which are special jets having smaller diameters and longer bores than each standard jet.

8. An industrial washing machine according to claim 7, wherein said source includes a sump for collecting washing fluid drained from each washing station during operation of the machine, there being conduit means by which said pressure fluid supply means communicate with the sump and with each of said at least one battery of jets, primary filtering means through which all washing fluid drawn from the sump by said pressure fluid supply means for feeding to said jets is directed and which are adapted to separate from washing fluid passed therethrough particles of solid matter which have a size which is greater than a predetermined minimum size, and secondary filtering means through which all washing fluid that is fed under pressure to each manifold casing is directed, the secondary filtering means being adapted to separate from the washing fluid passed therethrough particles of solid matter which have a size which is smaller than said predetermined minimum size.

9. An industrial washing machine according to claim 8, wherein the pressure fluid supply means comprise a tank, one pump which is operable to draw washing fluid from the sump and to feed it to the tank via said primary filtering means and another pump which is operable to draw washing fluid from the tank and to feed it under pressure to said jets via said conduit means.

10. An industrial washing machine according to claim 8, wherein the primary filtering means comprise at least one hydrocyclone.

* * * * *